US012048869B2

(12) United States Patent
Lee

(10) Patent No.: US 12,048,869 B2
(45) Date of Patent: Jul. 30, 2024

(54) BICYCLE SIMULATOR

(71) Applicant: REAL DESIGN TECH CO., LTD., Gyeonggi-do (KR)

(72) Inventor: Joong Sik Lee, Gyeonggi-do (KR)

(73) Assignee: REAL DESIGN TECH CO., LTD., Gyeonggi-Do (KR)

( * ) Notice: Subject to any disclaimer, the term of this patent is extended or adjusted under 35 U.S.C. 154(b) by 674 days.

(21) Appl. No.: 17/120,831

(22) Filed: Dec. 14, 2020

(65) Prior Publication Data

US 2021/0162291 A1 Jun. 3, 2021

Related U.S. Application Data

(63) Continuation of application No. PCT/KR2019/004519, filed on Apr. 15, 2019.

(30) Foreign Application Priority Data

Jun. 14, 2018 (KR) ..... 10-2018-0068394
Sep. 5, 2018 (KR) ..... 10-2018-0106047
Jan. 10, 2019 (KR) ..... 10-2019-0003288

(51) Int. Cl.
*A63B 71/06* (2006.01)
*A63B 22/06* (2006.01)
*A63B 24/00* (2006.01)

(52) U.S. Cl.
CPC ..... *A63B 71/0622* (2013.01); *A63B 22/0605* (2013.01); *A63B 24/0062* (2013.01);
(Continued)

(58) Field of Classification Search
CPC ..... A63B 71/0622; A63B 22/0605; A63B 24/0062; A63B 24/0087;
(Continued)

(56) References Cited

U.S. PATENT DOCUMENTS 4,958,832 A * 9/1990 Kim ..... A63B 22/16 482/61
2018/0072365 A1* 3/2018 Kalenga ..... A63B 22/0046
2019/0022497 A1* 1/2019 Hawkins, III ..... A63B 24/0087

FOREIGN PATENT DOCUMENTS

CN 204463303 U * 7/2015 ..... B62H 2003/005
CN 204463303 U 7/2015
(Continued)

OTHER PUBLICATIONS

Choi, KR1013550337B1-1 Translation of KR1013550337B1 (Year: 2014).*
(Continued)

*Primary Examiner* — Sundhara M Ganesan
*Assistant Examiner* — Jacqueline N L Loberiza
(74) *Attorney, Agent, or Firm* — Guntin & Gust, PLC; Miyoung Shin

(57) ABSTRACT

A bicycle simulator including a frame support portion for supporting a bicycle frame, the bicycle frame connecting front and rear wheels of the bicycle; and a base portion supporting the frame support portion. The frame support portion includes a first support bar having one end portion thereof fixed to the bicycle frame, a second support bar having one end portion thereof fixed to the base portion, and a connection portion for connecting the other end portion of the second support bar and the other end portion of the first support bar. The first support bar is connected to be rotatable about one axis with respect to the second support bar.

8 Claims, 19 Drawing Sheets

(52) U.S. Cl.
CPC .. *A63B 24/0087* (2013.01); *A63B 2022/0641* (2013.01); *A63B 2071/0644* (2013.01); *A63B 2071/0655* (2013.01); *A63B 2220/30* (2013.01); *A63B 2230/01* (2013.01)

(58) Field of Classification Search
CPC .... A63B 2022/0641; A63B 2071/0644; A63B 2071/0655; A63B 2220/30; A63B 2230/01
See application file for complete search history.

(56) References Cited

FOREIGN PATENT DOCUMENTS

| | | | | | |
|---|---|---|---|---|---|
| CN | 106861181 | A | | 6/2017 | |
| CN | 106861181 | A | * | 6/2017 | ..... G09B 9/058 |
| CN | 107137878 | A | * | 9/2017 | ..... A63B 71/0622 |
| EP | 3049162 | | * | 10/2015 | ..... A61B 5/024 |
| EP | 3049162 | A1 | | 8/2016 | |
| KR | 1020000060659 | A | | 10/2000 | |
| KR | 10-2010-0020337 | | | 2/2010 | |
| KR | 101350337 | B1 | * | 1/2014 | ..... A63B 22/0023 |
| KR | 10-1511677 | | | 4/2015 | |
| KR | 101511677 | | * | 4/2015 | ..... A63B 22/0605 |
| KR | 10-2015-0117460 | | | 10/2015 | |
| KR | 10-1677440 | | | 11/2016 | |
| KR | 10-1677713 | | | 11/2016 | |
| KR | 101677440 | | * | 11/2016 | ..... A63B 22/02 |
| KR | 101677713 | | * | 11/2016 | ..... A63B 22/02 |
| KR | 20170018533 | A | * | 2/2017 | ..... A63B 69/16 |
| KR | 101715292 | B1 | * | 3/2017 | ..... A63B 21/4033 |
| KR | 10-1827306 | | | 2/2018 | |
| KR | 101827306 | | * | 2/2018 | ..... A63B 21/005 |
| WO | WO-0124892 | A2 | * | 4/2001 | ..... A63F 13/2145 |
| WO | WO-2007122627 | A2 | * | 11/2007 | ..... A63B 21/22 |
| WO | 2015043658 | A1 | | 4/2015 | |
| WO | WO-2015043658 | | * | 4/2015 | ..... A61B 5/024 |

OTHER PUBLICATIONS

International Search Report for International Application PCT/KR2019/004519, mailed Jul. 26, 2019.

Office Action issued in corresponding KR Application 10-2016-0003288, mailed Dec. 18, 2019.

Notice of Allowance issued in corresponding KR Application 10-2019-0003288, mailed Jun. 16, 2020.

Extended European Search Report issued in related European Application No. 19820308.5 dated Jan. 13, 2022, 10 pages.

* cited by examiner

BICYCLE SIMULATOR

CROSS-REFERENCE TO RELATED APPLICATIONS

This application is a continuation of International Application No. PCT/KR2019/004519, filed on Apr. 15, 2019, which claims priority to and the benefit of Korean Patent Application No. 10-2019-0003288, filed on Jan. 10, 2019, Korean Patent Application No. 10-2018-0106047, filed on Sep. 5, 2018, and Korean Patent Application No. 10-2018-0068394, filed on Jun. 14, 2018. The disclosures of the above applications are incorporated herein by reference.

TECHNICAL FIELD

The present disclosure relates to a bicycle simulator for virtual rides, and more particularly, to a bicycle simulator in which various travel routes may be virtually experienced in an indoor space and exercise effects may be obtained.

BACKGROUND

In general, bicycle exercise equipment known as bicycle trainers or bicycle rollers is the most widely used indoor exercise fitness equipment along with treadmills. Here, a rider on a bicycle mounted on a rotating roller or a cradle uses pedals to rotate the wheels to which rotational resistance (magnetic force, etc.) is applied, so as to strengthen the muscles of the lower body.

Such bicycle exercise equipment of the related art has an advantage in that a considerably high exercise effect is provided to a rider with only a relatively short time of exercise through the adjustment of rotational resistance applied to the wheels, regardless of the weather.

However, with the bicycle exercise equipment of the related art, a pedaling exercise to which rotational resistance is applied is simply continued while facing the wall in an enclosed indoor space. Thus, there is a drawback in that it is difficult to continue the continuous pedaling exercise due to boredom as it is not possible to provide the rider with the pleasure of riding a real bicycle.

In order to improve the above problem, Prior Art 1 (Korean Patent No. 10-1677713) and Prior Art 2 (Korean Patent No. 10-1827306) disclose technologies relating to cycle exercise equipment.

In Prior Art 1, by replacing three or more roller portions each rotating about a fixed axis (center axis) and having different outer wall shapes, the rider may be provided with a travel experience on various road conditions, similar to riding a real bicycle, and through the interest induced thereby, the rider may continue the pedaling movement in a continuous manner. However, the cycle exercise equipment presented in Prior Art 1 rotates three or more roller portions themselves back and forth, and due to the implementation of various road surfaces, the structure is complex, and manufacturing or maintenance difficulties are expected. Further, when the roller portions rotate for the sake of changing a road surface, the bicycle itself that is being pedaled inevitably moves largely in a vertical direction, which greatly impedes the safety of the rider on the bicycle and cannot realize natural changes in the road surface.

In Prior Art 2, an uneven portion, which may implement a virtual road surface, protrudes along the roller portion, and thus, a safer riding experience and natural changes of the road surface may be provided to the rider. However, the cycle exercise equipment presented in Prior Art 2 only implements a flat virtual road surface, and cannot implement various travel modes according to an actual travel environment having a slope and the type of rider.

SUMMARY

The present disclosure to provide a bicycle simulator whereby a road surface having a slope is realized, while various travel modes enabling a steering range to be adjusted according to the type of rider are realized, and thus, a dynamic experience which is extremely similar to an actual riding situation may be possible.

According to an embodiment of the disclosure, a bicycle simulator includes a frame support portion for supporting a bicycle frame, the bicycle frame connecting front and rear wheels of the bicycle, and a base portion supporting the frame support portion, wherein the frame support portion includes a first support bar having one end portion thereof fixed to the bicycle frame, a second support bar having one end portion thereof fixed to the base portion, and a connection portion for connecting the other end portion of the second support bar and the other end portion of the first support bar, wherein the first support bar is connected to be rotatable about one axis with respect to the second support bar.

As the first support bar rotates with respect to the second support bar, the bicycle may be tilted at the same angle as a rotation angle of the first support bar.

The bicycle simulator may further include a front wheel support portion for supporting the front wheel of the bicycle and rotating together with rotation of the front wheel, and first and second rear wheel support portions that respectively support two points of the rear wheel of the bicycle and rotate together according to rotation of the rear wheel.

The bicycle simulator may further include a rotation controller for limiting a rotation angle of the first support bar with respect to the second support bar and restoring a position of the rotated first support bar.

The bicycle simulator may further include a weight-measuring portion for measuring the weight of a rider on the bicycle.

The connection portion may include a hinge housing provided on the first support bar and the second support bar, and a hinge shaft inserted into the hinge housing.

The one end portion of the first support bar may include a contact portion in contact with a portion of the bicycle frame, the contact portion being provided with an electromagnet to fix the bicycle frame to the contact portion.

The contact portion may have a first support surface and a second support surface, which are arranged to face each other with a preset distance therebetween, and a portion of the bicycle frame may be arranged to be inserted between the first support surface and the second support surface, and be in contact with and supported by the first support surface and the second support surface.

The bicycle simulator may further include a speed measuring portion for calculating a travel speed from rotation of the rear wheel, and an air-blowing device that provides variable wind to a rider according to a travel speed calculated by the speed measuring portion.

The bicycle simulator may further include a display device for visually providing a preset travel environment to a rider, and the first support bar may rotate about one axis with respect to the second support bar to match a slope of a travel environment provided in real time through the display device.

The bicycle simulator may further include a movement limiting portion arranged between the first support bar and the second support bar to prevent horizontal movement of the first support bar in the direction of the one axis with respect to the second support bar.

The bicycle simulator may further include a leg support portion arranged at opposite side portions of the base portion to support legs of a rider on the bicycle.

According to an embodiment, a bicycle simulator includes a frame support portion for supporting a frame of a mounted bicycle, the frame connecting front and rear wheels of the bicycle, a slide guide fixed to the base portion and extending in a first direction, a slide portion fixed to the frame support portion and connected to be movable in the first direction in the slide guide, and a movement interval adjustment portion for adjusting a movement interval through which the slide portion is capable of moving in the slide guide, according to a travel mode.

In a first travel mode, the slide portion may move along by an interval of 10 cm or more and 20 cm or less, in a second travel mode, the slide portion may move along by an interval of more than 20 cm and 40 cm or less, and in a third travel mode, the slide portion may move along by an interval of 40 cm or more.

The bicycle simulator may further include an input unit for inputting the first to third travel modes, and a controller for adjusting a movement interval capable of being moved in the slide guide, according to a travel mode input to the input unit.

The bicycle simulator may further include a front wheel support portion for supporting the front wheel of the bicycle and rotating together with rotation of the front wheel, and first and second rear wheel support portions respectively supporting two points of the rear wheel of the bicycle and rotate together according to rotation of the rear wheel.

As the slide portion moves in the first direction, the front wheel of the bicycle may move on an upper surface of the front wheel support portion in the first direction, and the rear wheel of the bicycle may move on upper surfaces of the first and second rear wheel support portions in the first direction.

The bicycle simulator may further include a rotation slide guide portion arranged on an upper portion of the slide portion and extending along a circumferential direction around a second direction that is perpendicular to the first direction, and a rotation slide portion which is arranged to be engaged with the rotating slide guide portion and rotates the frame support portion about the second direction with respect to the slide portion.

The bicycle simulator may further include a rotation restraint portion for limiting a rotation angle of the frame support portion with respect to the slide portion.

A rotation angle of the frame support portion with respect to the slide portion may be 0 degrees or more and 20 degrees or less.

According to the present disclosure, as a first support bar rotating about one axis with respect to a second support bar is provided on a frame support, a rider on the bicycle may virtually experience various road conditions having a slope and thus enjoy a dynamic and realistic ride.

In addition, a variety of travel modes, in which a steering range may be adjusted according to the type of rider, is provided, and thus, the exercise effect may be naturally maximized according to the type of the rider.

Further, when a weight measuring portion, a controller, a speed measuring portion, an air-blowing device, and a display device are organically coupled with each other, controlled, and operated, the rider may be provided with a more realistic and interesting virtual riding environment.

DETAILED DESCRIPTION OF EMBODIMENTS

Figure 1:
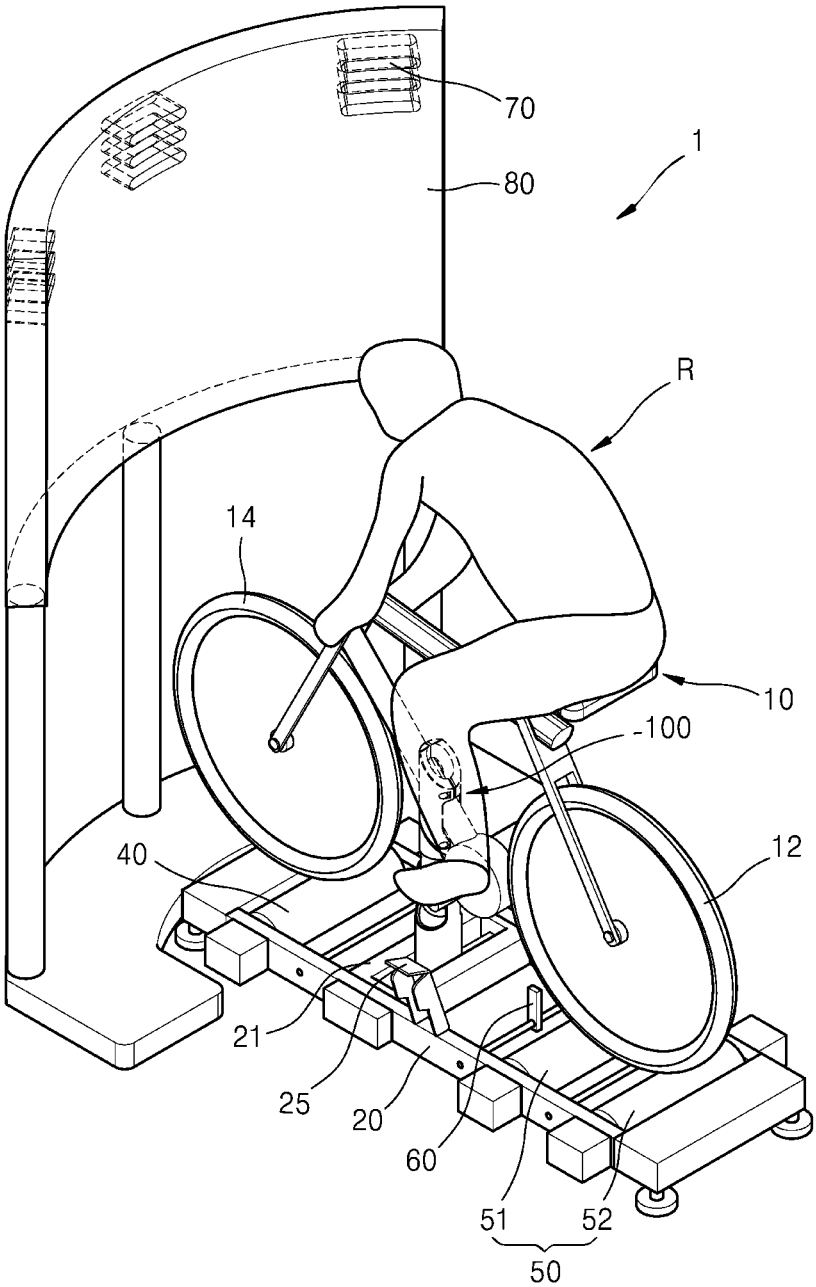
FIG. 1 is a perspective view of a bicycle simulator according to an embodiment of the present disclosure.

Hereinafter, the embodiments of the present disclosure will now be described more fully with reference to the accompanying drawings. Like reference symbols in the drawings denote like elements, and thus descriptions thereof will be omitted.

As embodiments allow for various changes, example embodiments will be illustrated in the drawings and described in detail in the written description. Effects and features of the present embodiments, and methods for achieving them will be clarified with reference to details described below in detail with reference to the drawings. However, the present embodiments are not limited to the following embodiments and may be embodied in various forms.

While such terms as "first," "second," etc., may be used to describe various components, such components are not be limited to the above terms. The above terms are used only to distinguish one component from another.

The singular forms "a," "an," and "the" as used herein are intended to include the plural forms as well unless the context clearly indicates otherwise.

In the following embodiments, the up (above), down (below), left and right (lateral), front (forward), rear (back), etc. that indicate directions are not intended to limit the rights, but are determined based on the drawings and a relative position between the components, for convenience of explanation. Thus, each direction described below is based on this, except for a case specifically limited otherwise.

In the present specification, it is to be understood that the terms "including," "having," and "comprising" are intended to indicate the existence of the features or components described in the specification, and are not intended to preclude the possibility that one or more other features, numbers, steps, actions, components, parts, or combinations thereof may exist or may be added.

Sizes of components in the drawings may be exaggerated for convenience of explanation. In other words, since sizes and thicknesses of components in the drawings are arbitrarily illustrated for convenience of explanation, the following embodiments are not limited thereto.

Figure 2:
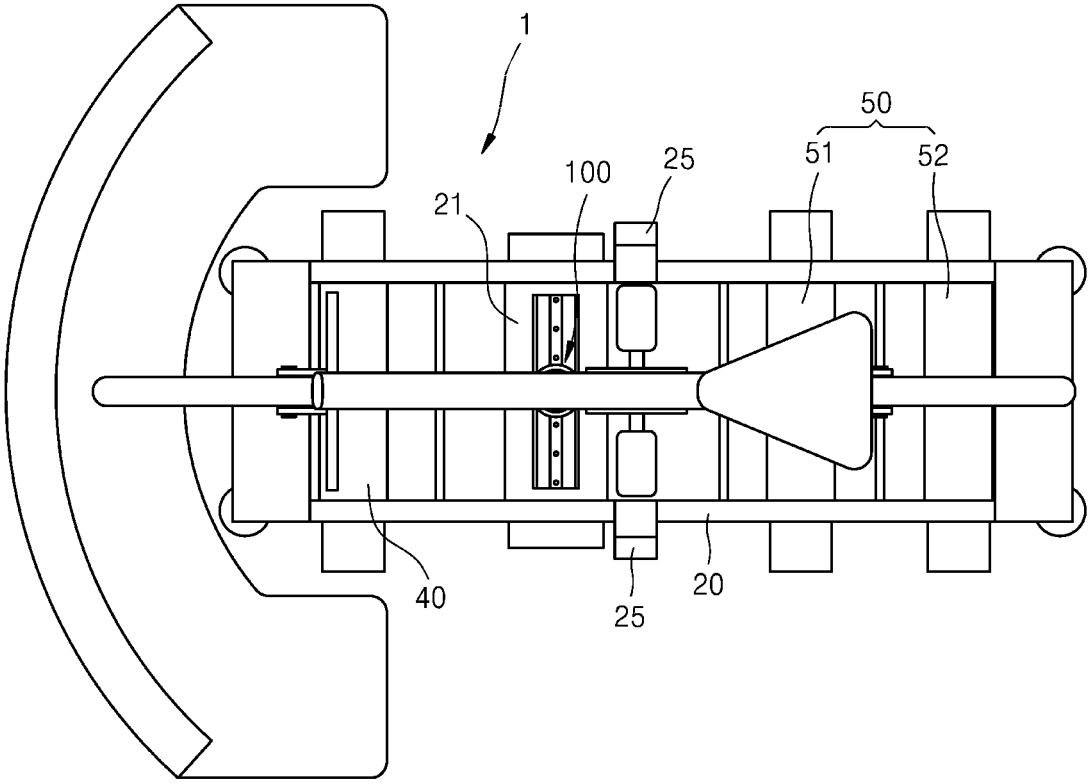
FIG. 2 is a plan view of the bicycle simulator shown in FIG. 1.
Figure 3A:
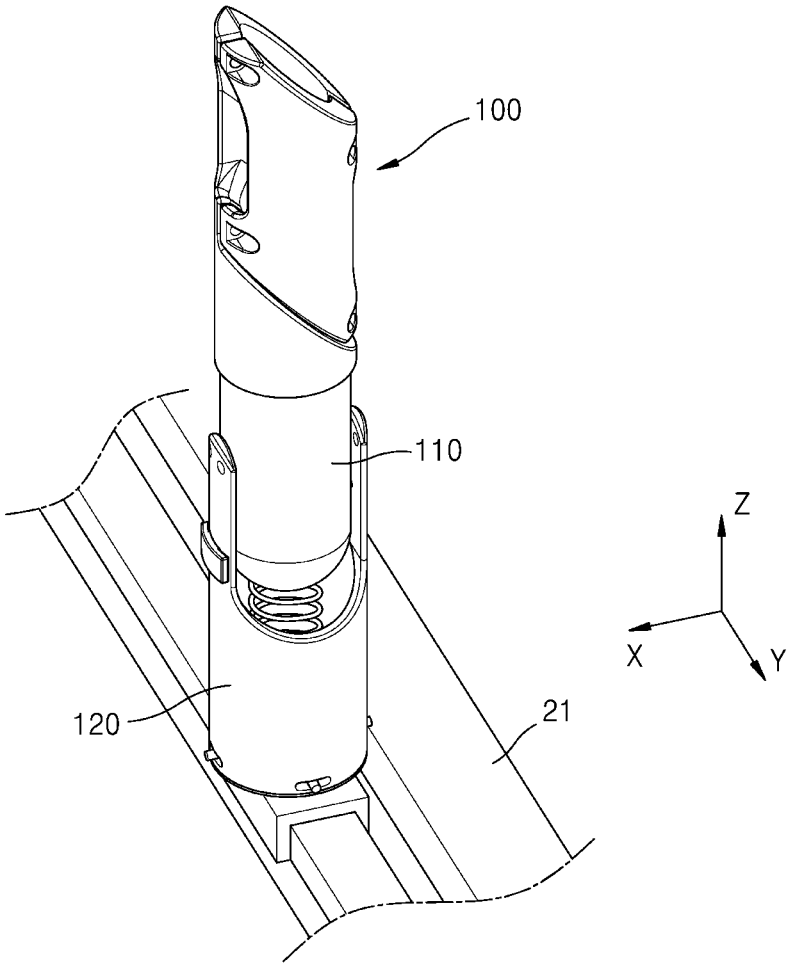
FIG. 3A is a perspective view of a frame support portion according to the present disclosure.
Figure 3B:
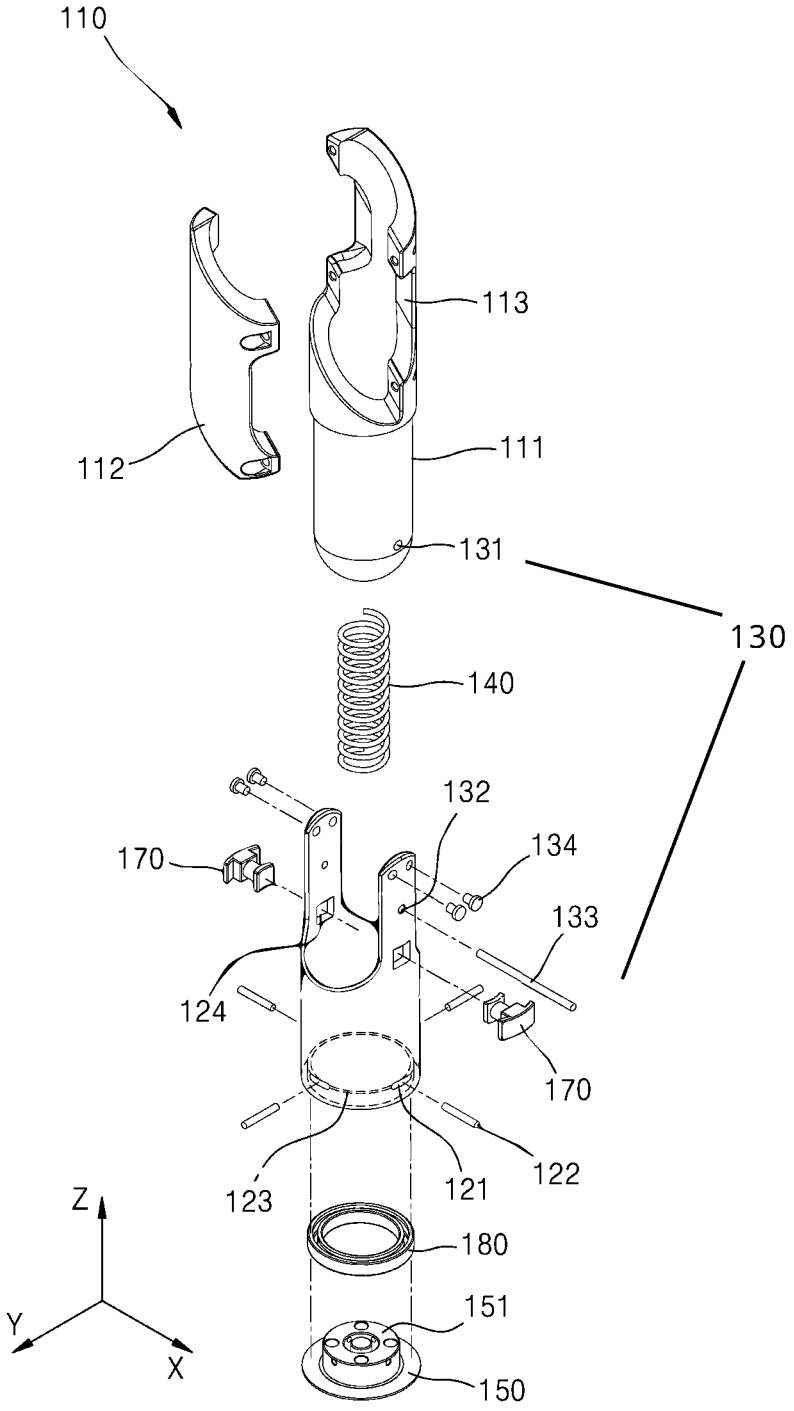
FIG. 3B is an exploded perspective view of the frame support portion shown in FIG. 3A.
Figure 3C:
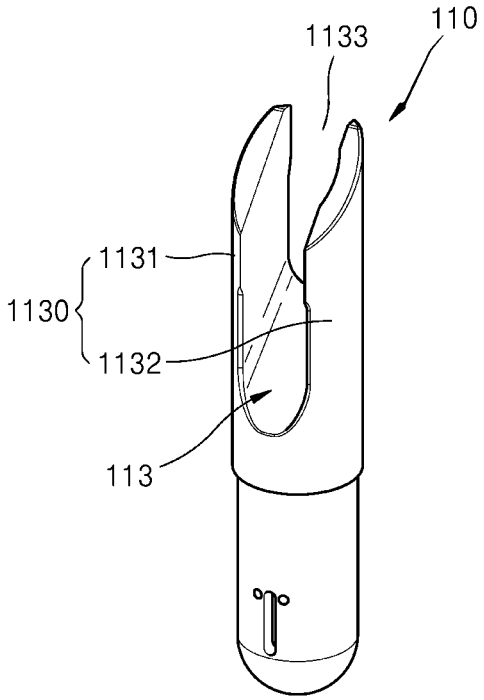
FIG. 3C is a perspective view of a first support bar according to another embodiment.

FIG. 1 is a perspective view of a bicycle simulator, according to an embodiment of the present disclosure. FIG. 2 is a plan view of the bicycle simulator shown in FIG. 1. FIG. 3A is a perspective view of a frame support portion, according to the present disclosure. FIG. 3B is an exploded perspective view of the frame support portion shown in FIG. 3A. FIG. 3C is a perspective view of a first support bar, according to another embodiment.

In a bicycle simulator 1 according to an embodiment of the present disclosure, a rider R on a bicycle 10 may virtually experience various road surface conditions having a slope, and thus, a dynamic and realistic ride may be enjoyed. In addition, a variety of travel modes, in which a steering range may be adjusted according to the type of the rider R, is provided, and thus, the exercise effect may be naturally maximized according to the type of the rider R.

The bicycle 10 mentioned above not only is specially manufactured for only the bicycle simulator 1 according to an embodiment of the present disclosure, but also is a concept that encompasses all bicycles 10 currently available on the market by various manufacturers. The bicycle 10 may include a bicycle frame 11 constituting the body of the bicycle 10, a front wheel 14 and a rear wheel 12, which are rotatably mounted on the bicycle frame 11, and a drivetrain (crank, chain, transmission, etc.) that converts pedaling of the rider R to a rotational force of the rear wheel 12.

The bicycle simulator 1 according to an embodiment of the present disclosure includes a base portion 20, a front wheel support portion 40, a rear wheel support portion 50, and a frame support portion 100, which are to implement the functions or actions as described above.

Each of the configurations described above will now be described below in detail.

Referring to FIGS. 1 and 2, the base portion 20 according to an embodiment of the present disclosure is a support member that may be fixed to the ground to support the bicycle 10. As an example, the base portion 20 may be provided in the shape of a rectangular frame on which the front wheel support portion 40 and the rear wheel support portion 50 to be described later may be mounted. However, the present disclosure is not limited thereto, and an arbitrary support member on which the front wheel support portion 40 and the rear wheel support portion 50 may be mounted may be provided. In addition, in the base portion 20 according to an example, a support frame 21, to which the frame support portion 100 may be fixed, may be arranged across the opposite side portions of the base portion 20.

A leg support portion 25 may be arranged at opposite side portions of the base portion 20 to support legs of the rider R. As an example, when the rider R is stopped on the bicycle 10 before travelling, it may be difficult for the rider R to hold the center. At this time, the leg support portion 25 capable of supporting legs of the rider R may be arranged at both side portions of the base portion 20 so that the rider R may hold the center. For example, the leg support portion 25 having an inclined surface to support legs of the rider R may be provided, but the present disclosure is not limited thereto.

The front wheel support portion 40 is a rod-shaped component that supports the front wheel 14 of the bicycle 10 mounted on the bicycle simulator 1 and rotates together with the front wheel 14, and the either end portions of the front wheel support portion 40 may form a shaft coupling with the base portion 20 so that the front wheel support portion 40 may freely rotate forward or backward based on the mounted bicycle 10.

The rear wheel support portion 50 is a rod-shaped component that supports the rear wheel 12 of the bicycle 10 mounted on the bicycle simulator 1 and rotates together with the rear wheel 12, and the either end portions of the rear wheel support portion 50 may form a shaft coupling with the base portion 20 so that the rear wheel support portion 50 may freely rotate forward or backward based on the mounted bicycle 10.

The front wheel support portion 40 and the rear wheel support portion 50 as described above may be of any shape that may rotate together with the rotation of the front wheel 14 and the rear wheel 12 while contacting the front wheel 14 and the rear wheel 12. Accordingly, the longitudinal sections of the front wheel support portion 40 and the rear wheel support portion 50 may each be polygonal, elliptical, or circular. At this time, the front wheel 14 and the rear wheel 12 of the bicycle 10 may freely move on the upper surfaces of the front wheel support portion 40 and the rear wheel support portion 50, respectively.

As an example, the front wheel support portion 40 and the rear wheel support portion 50 according to the present disclosure may each include a circular longitudinal section as shown in FIGS. 1 to 2, so that smooth rotation may be possible according to the rotation of the front wheel 14 and the rear wheel 12 without a heterogeneous feeling of ride given to the rider R that rotates the front wheel 14 and the rear wheel 12. In addition, the rear wheel support portion 50 according to the present disclosure may include two rear wheel support portions 50, that is, a first rear roller 51 and a second rear roller 52, which rotate while supporting the rear roller 12 back and forth from the bottom of the rear wheel 12, for stable support of the rear wheel 12.

Referring to FIGS. 3A and 3B, the frame support portion 100 according to an embodiment is a support member for stably fixing a position of the bicycle 10 by being detachably coupled to the bicycle frame 11, and may include a first support bar 110, a second support bar 120, a connection portion 130, a rotation controller 140, a weight measuring portion 150, a movement limiting portion 170, and a rotation slide guide 180.

The first support bar 110 is a linear rod-shaped support member, which extends in one direction. As an example, one end portion of the first support bar 110 may include a $(1\text{-}1)^{st}$ support bar 111 and a $(1\text{-}2)^{nd}$ support bar 112, which are provided so as to be detachable from each other. The $(1\text{-}1)^{st}$ support bar 111 and the $(1\text{-}2)^{nd}$ support bar 112 may be separated from each other to be detachably coupled to one side (downtube) of the bicycle frame 11. At this time, a clamp 113 structure, to which one side (downtube) of the bicycle frame 11 may be detachably coupled, may be formed by the coupling of the $(1\text{-}1)^{st}$ support bar 111 with the $(1\text{-}2)^{nd}$ support bar 112. In addition, a connection structure that may be connected to the other end portion of the second support bar 120, which will be described later below, may be provided at the other end portion of the first support bar 110.

As an example, the clamp 113 may be provided in a cylindrical shape, into which a portion of the bicycle frame 11 is inserted. At this time, the clamp 113 may be formed to fix a portion of the bicycle frame 11, and thus, the bicycle 10 may be supported by the bicycle simulator 1.

As another example, the clamp 113 may be provided in a horseshoe shape, into which a portion of the bicycle frame 11 is inserted, as shown in FIG. 3C. In this case, a contact portion 1130 provided in the clamp 113 may include a first support surface 1131 and a second support surface 1132, which are arranged to face each other with a certain interval therebetween. In addition, when the clamp 113 structure is provided in a horseshoe shape as described above, the first support bar 110 may be provided integrally. As an example, a portion of the bicycle frame 11, for example, a downtube of the bicycle frame 11, may be inserted between the first support surface 1131 and the second support surface 1132 via a bicycle entry portion 1133. In this case, the downtube of the bicycle frame 11 may be arranged to contact the first support surface 1131 and the second support surface 1132. As an example, the contact portion 1130 may be provided as an electromagnet, and the bicycle frame 11 may be fixed to the contact portion 1130 according to driving of the electromagnet.

The second support bar 120 is a linear rod-shaped support member that extends in one direction, and the first support bar 110 may be connected to the second support bar 120 so that it may rotate about one axis X with respect to the second support bar 120. For example, one end portion of the second support bar 120 may be arranged to be rotatable with respect to the support frame 21 provided in the base portion 20. As an example, a staircase-shaped rotation slide portion 123 may be provided at one end portion of the second support bar 120, and the rotation slide portion 123 may rotate about the Z-axis while engaging with the rotation slide guide 180, which will be described later below. At this time, in the second support bar 120, a plurality of long holes 121, for example, four long holes, for limiting a range of rotation about the Z-axis may be arranged to be spaced apart from each other with a preset interval therebetween. A rotation restraint portion 122 may be inserted into each of the plurality of long holes 121, limiting a rotation of the second support bar 120 about the Z-axis. As an example, the rotation restraint portion 122 may be provided in a rod shape extending in one direction. In addition, a connection structure, which may be connected to the other end of the first support bar 110, may be provided at the other end portion of the second support bar 120.

The connection portion 130 is a connection member for connecting the other end portion of the second support bar 120 to the other end portion of the first support bar 110 so that the first support bar 110 may rotate about the one axis X with respect to the second support bar 120. As an example, the connection portion 130 includes a hinge shaft 133, which is inserted into a first hinge ball 131 and a second hinge ball 132, to hingeably couple the first support bar 110 to the second support bar 120. At this time, the hinge shaft 133 may extend in the one axis X direction, and thus, the first support bar 110 may rotate about the one axis X with respect to the second support bar 120. In the above-described embodiment, the connection portion 130 is implemented by hinged coupling, but the present disclosure is not limited thereto. Any connection portion 130 that connects the first support bar 110 to the second support bar 120 such that the first support bar 110 may rotate about the one axis X with respect to the second support bar 120 may be used. A separate fastening portion 134 capable of restricting rotation of the first support bar 110 with respect to the second support bar 120 may be provided in the connection portion 130. As an example, the fastening portion 134 may be provided in a screw shape and may detachably couple the first support bar 110 to the second support bar 120 to thereby restrict the rotation of the first support bar 110 with respect to the second support bar 120.

The rotation controller 140 is an angle-limiting member that may limit a rotation angle of the first support bar 110 with respect to the second support bar 120. As an example, one end portion of the rotation controller 140 may be arranged to be fixed to an end of the first support bar 110, and the other end portion of the rotation controller 140 may be arranged to be fixed to the base portion 20. For example, the other end portion of the rotation controller 140 may be arranged to be fixed to the support frame 21 provided in the base portion 20. In addition, as an example, the rotation controller 140 may be provided as a stretchable elastic member, and thus, the first support bar 110 may be restrained to be inclined by a preset angle with respect to the second support bar 120 within an elastic limit range of the rotation controller 140. In addition, the first support bar 110, which rotates about the second support bar 120 by an external force of the rider R, may receive a restoring force for returning to the initial position, from the rotation controller 140.

The weight-measuring portion 150 is a sensor member for measuring a weight of the rider R on the bicycle 10. As an example, the weight-measuring portion 150 may be implemented as a gravity sensor, etc., in which a weight of the rider R on the bicycle 10 may be measured. However, the present disclosure is not limited thereto, and any sensor member that may measure the weight of the rider R on the bicycle 10 may be used. As an example, the weight-measuring portion 150 may be arranged to be fixed to the support frame 21, and at this time, the other end portion of the rotation controller 140 may be arranged to be fixed to the weight-measuring portion 150. In addition, the rotation restraint portion 122 may be arranged to be fixed to an insertion hole 151 arranged in the weight measuring portion 150 and may move along the plurality of long holes 121.

The movement-limiting portion 170 is a movement restraint member, in which the first support bar 110 may be prevented from moving in one axial direction X with respect to the second support bar 120. As an example, a certain spaced interval may be generated between the first support bar 110 and the second support bar 120 according to manufacturing tolerances. The movement-limiting portion 170 is arranged between the first support bar 110 and the second support bar 120 to eliminate a spaced interval between the first support bar 110 and the second support bar 120, and thus, the movement in the x-axis direction of the first support bar 110 with respect to the second support bar 120 may be prevented.

The rotation slide guide 180 is a guide member that may engage with the rotation slide portion 123 provided at one end portion of the second support bar 120 to guide a rotation of the second support bar 120. As an example, the rotation slide guide 180 may be arranged to be fixed on the upper portion of the weight-measuring portion 150, and may be provided in a guide shape that extends in a second direction, which is perpendicular to a first direction Y, for example, in a circumferential direction around the Z-axis. Accordingly, the second support bar 120 may rotate about the Z-axis with respect to the weight-measuring portion 150, more specifically, the support frame 21 provided in the base portion 20.

Referring back to FIGS. 1 and 2, the speed measuring portion 60 is a component that calculates a travelling speed from a size of the circumference of the rear wheel 12 and the number of rotations of the rear wheel 12 per unit time, and may be installed in a location adjacent to the rear wheel 12 in order to accurately count the number of rotations of the rear wheel 12.

The air-blowing device 70 is a component for providing wind, which is variable, to the rider R according to the travelling speed calculated in the speed measuring portion 60, and a pair of air-blowing devices 70 may be each provided at the upper left and right sides of the display device 80, which will be described later below, while being oriented toward the rider R. The travelling speed calculated in real time from the speed measuring portion 60 as described above may be transmitted to a controller (not shown) as travelling information for a specific area or course of a bicycle competition selected by the rider R. In addition, the controller (not shown) that receives the travelling speed operably controls the air-blowing device 70 with an intensity corresponding to the speed so that a dynamic and realistic riding experience may be provided to the rider R.

The display device 80 is a component that visually conveys a travel environment for a course of a bicycle competition, an operating system program, or etc. to the rider R, and may be a display device 80 having a curved shape of a size that covers all of the front viewing angle of the rider R as shown in FIG. 1, or a goggle-type display device (not shown) worn by the rider R. As an example, when the display device 80 realistically displays a preset travel environment, etc., the rider R may adjust an inclination angle of the bicycle 10 in various ways based on road surface condition information corresponding to a travel environment provided in real time.

Figure 4:
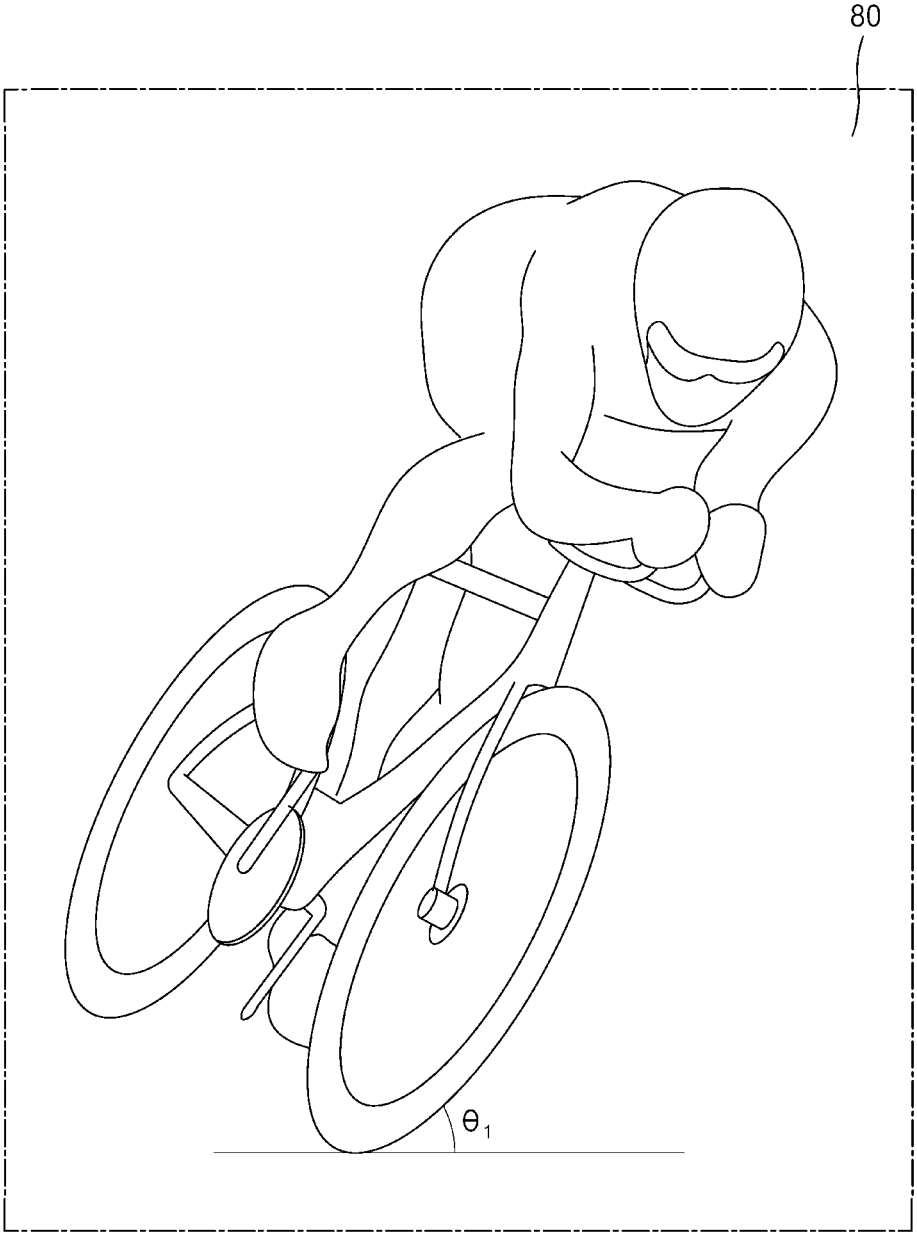
FIG. 4 is a schematic diagram of a display device in which a travelling scene having a slope is displayed, according to an embodiment of the present disclosure.

As described above, the rider R on the bicycle 10 may experience, not only visually but also with the whole body, various road surface conditions having an inclination angle as shown in FIG. 4, in conjunction with the display device 80, and thus, a more dynamic and exciting ride may be enjoyed in the indoor space.

Figure 5:
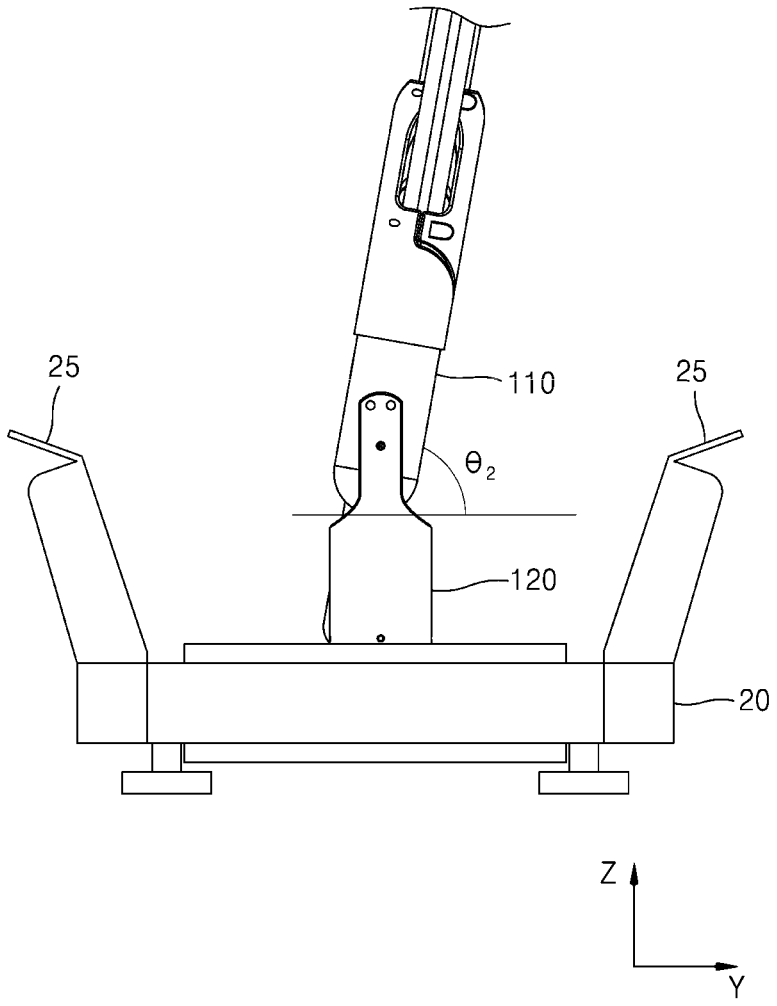
FIG. 5 is a front view of a bicycle simulator according to an embodiment of the present disclosure.
Figure 6:
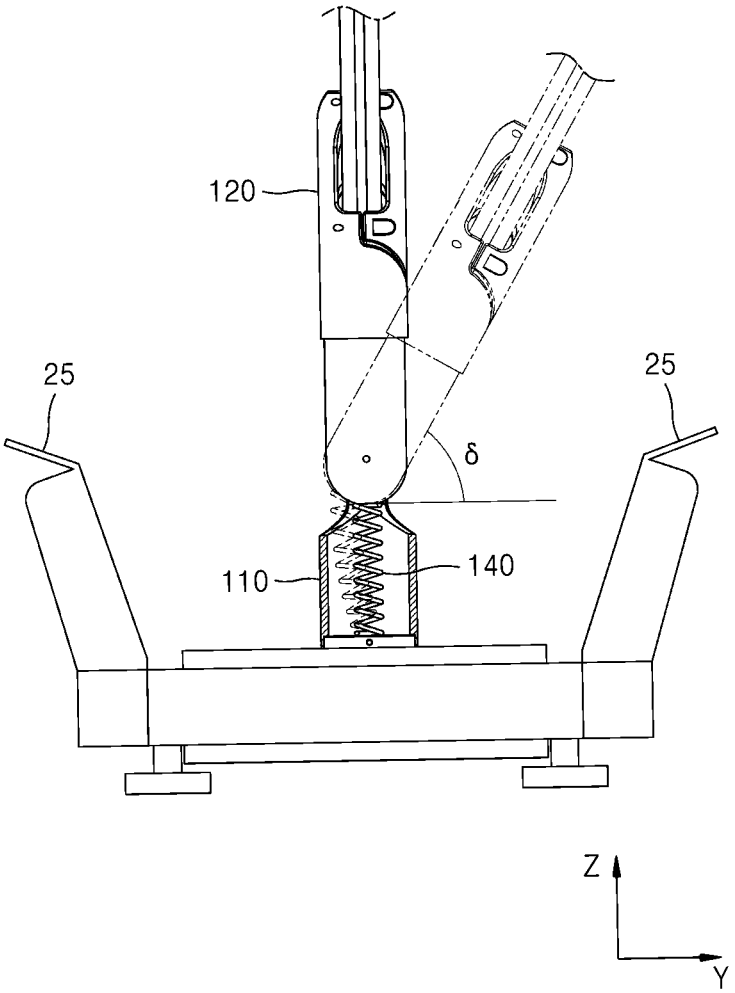
FIG. 6 is a partial schematic diagram of a frame support portion according to an embodiment of the present disclosure.

FIG. 4 is a schematic diagram of a display device in which a travelling scene having a slope is displayed, according to an embodiment of the present disclosure. FIG. 5 is a front view of a bicycle simulator, according to an embodiment of the present disclosure. FIG. 6 is a partial schematic diagram of a frame support portion, according to an embodiment of the present disclosure.

Referring to FIG. 4, a state of the rider R on a bicycle travelling on an inclined road having a first inclination angle $\theta_1$ may be displayed on the display device 80. As an example, such a travel route may implement a velodrome used in a cycling-only stadium or a mountain bike path. At this time, the rider R boarding the bicycle simulator 1 according to an embodiment of the present disclosure may recognize a riding situation displayed on the display device 80 and then, manipulate the bicycle 10 to respond to the riding situation. As an example, as shown in FIG. 5A, the rider R may travel by tilting the bicycle 10 to have a second inclination angle $\theta_2$ with respect to a plane parallel to the base portion 20.

When the rider R travels on the tilted bicycle 10, as shown in FIG. 6, the first support bar 110 supporting a portion of the bicycle 10 may rotate about the one axis X with respect to the second support bar 120. In this case, a rotation angle $\delta$ of the first support bar 110 may be substantially the same as the second inclination angle $\theta_2$. In addition, at this time, the rotation controller 140, which is arranged to be fixed to an end of the first support bar 110, may limit the rotation angle $\delta$ of the first support bar 110 so that the first support bar 110 does not incline more than a threshold rotation angle $\delta$, for example, more than 60 degrees. As an example, when the rotation controller 140 is provided as an elastic member, the rotation controller 140 may extend as the first support bar 110 rotates with respect to the second support bar 120. At this time, by the elastic restoring force of the rotation controller 140, an inclination angle of the first support bar 110 may be limited so that the first support bar 110 may not rotate more than the threshold rotation angle $\delta$. Thus, the rider R may more safely enjoy a bicycle ride. In addition, when an external force is not applied to the bicycle 10 by the rider R or an external force less than a preset threshold is applied to the bicycle 10, the extended rotation controller 140 may be shortened, and thus, a position in which the first support bar 110 rotates may be restored. In the present embodiment, the rotation controller 140 is implemented as an elastic member. However, another restraint member capable of restraining the rotation of the first support bar 110 may be arranged. In addition, the rotation controller 140 may stepwise restrain the rotation angle $\delta$ of the first support bar 110 with respect to the second support bar 120.

As described above, as the first support bar 110 rotates about the one axis X with respect to the second support bar 120 within a preset range, the rider R may more safely enjoy a dynamic experience in an indoor space as if travelling on a velodrome or a mountain bike path having an inclination angle.

Figure 7A:
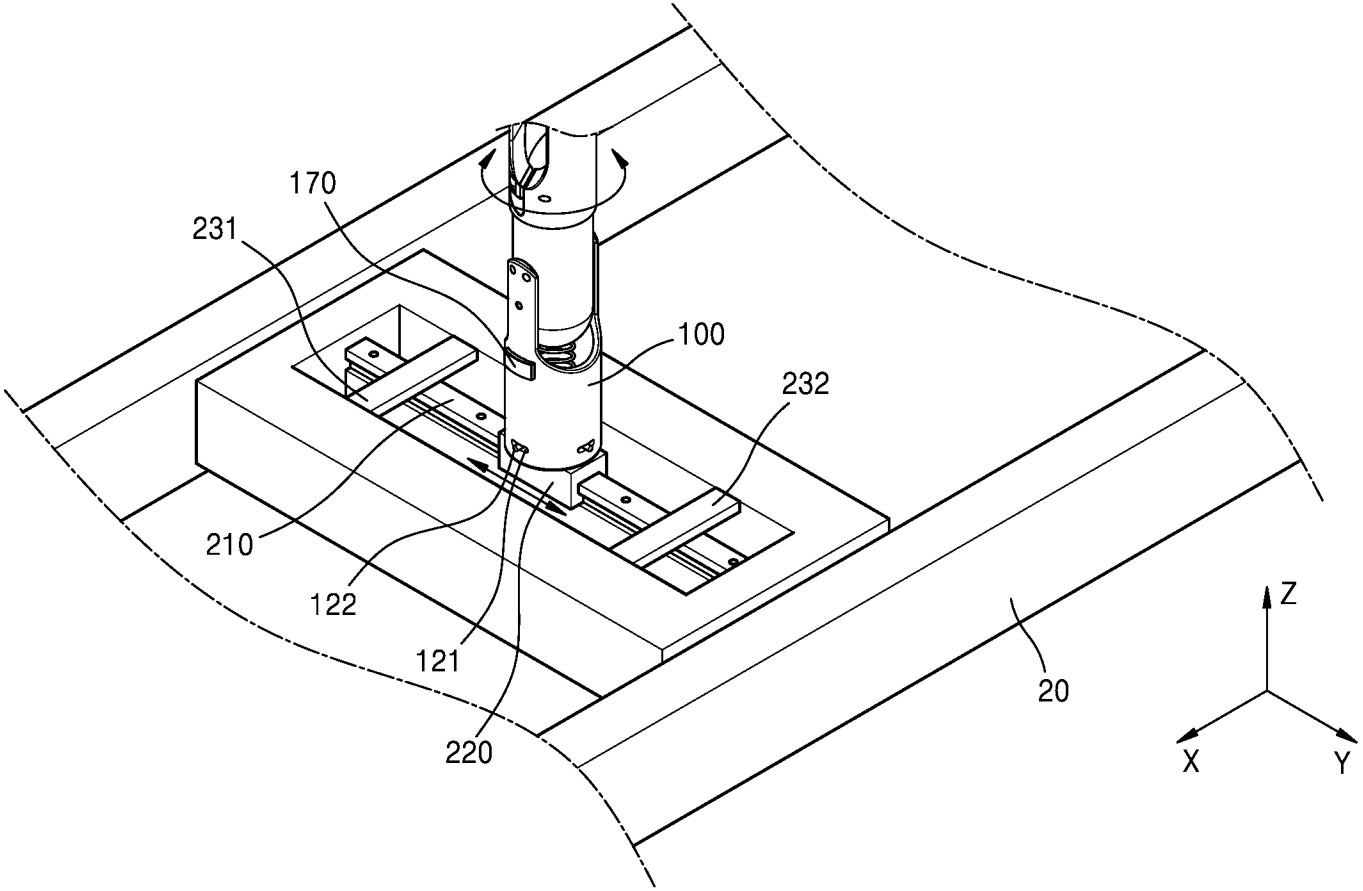
FIG. 7A is a partial perspective view of a bicycle simulator according to another embodiment.
Figure 7B:
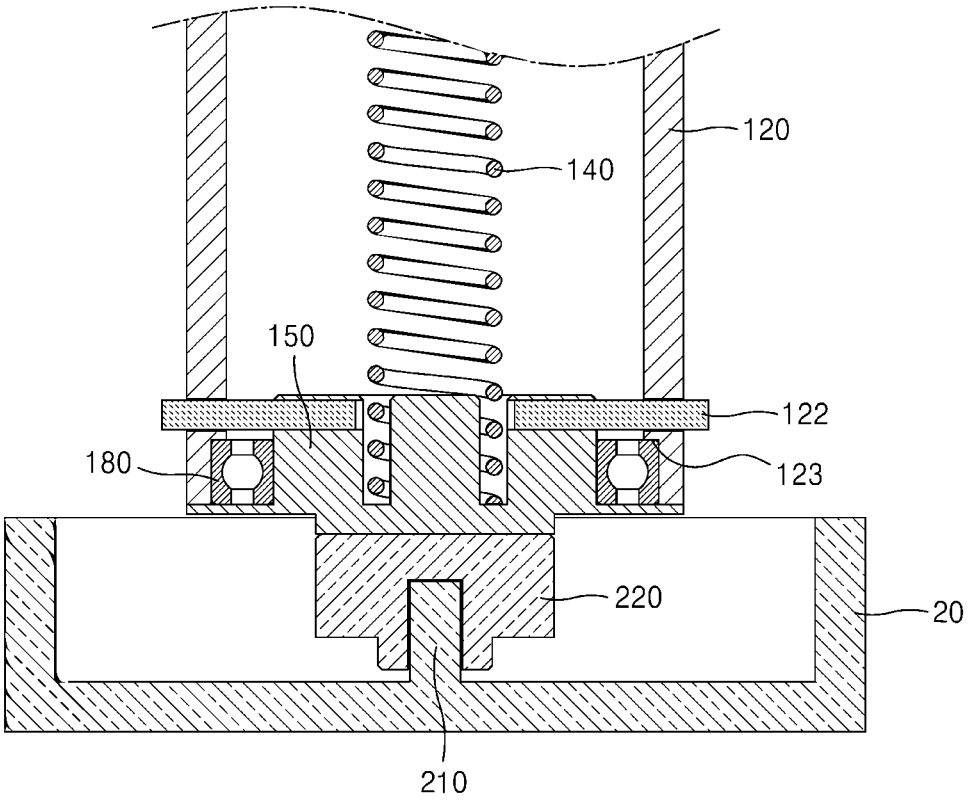
FIG. 7B is a partial cross-sectional view of a bicycle simulator according to another embodiment.
Figure 7C:
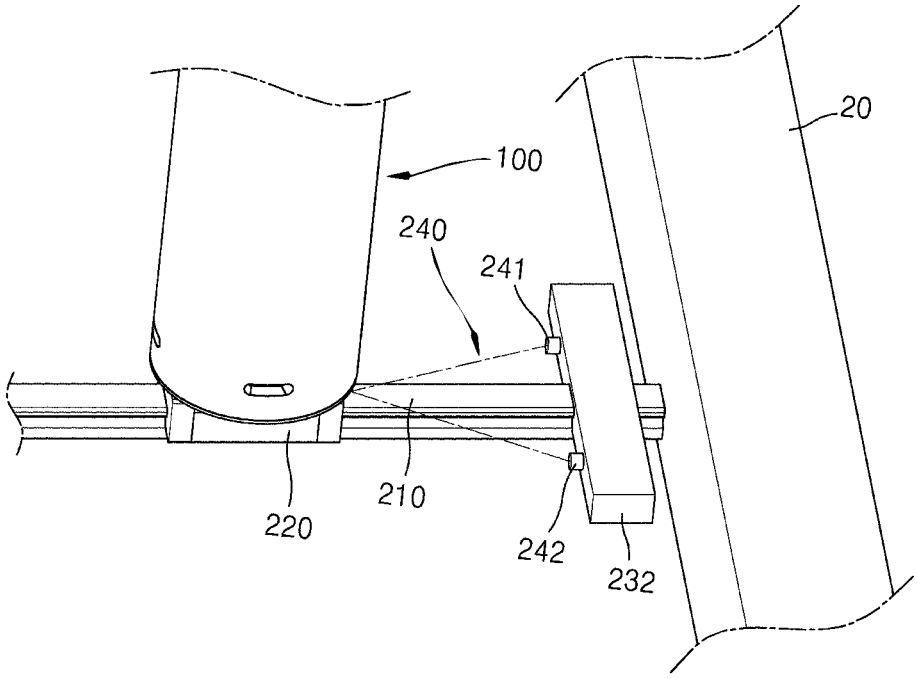
FIG. 7C is a partial perspective view of a bicycle simulator, according to another embodiment.

FIG. 7A is a perspective view of a bicycle simulator, according to another embodiment. FIG. 7B is a partial cross-sectional view of a bicycle simulator, according to another embodiment. FIG. 7C is a partial perspective view of a bicycle simulator, according to another embodiment. Configurations that are substantially the same as those described with reference to FIGS. 1 to 6 are omitted for convenience of description.

Referring to FIGS. 7A to 7C, the bicycle simulator 1 according to an embodiment may further include a slide guide 210 arranged in an upper portion of the base portion 20, a slide portion 220 fixed to one end portion of the frame support portion 100 and connected to the slide guide 210 so as to move along the slide guide 210, a movement interval adjustment portion 230 capable of adjusting a movement interval of the slide portion 220, and a movement interval detection portion 240 capable of detecting a movement interval of the slide guide 210.

The slide guide 210 may be formed as a slide rail that extends in a first direction Y. As an example, the slide guide 210 may be arranged to be fixed to the upper portion of the base portion 20, more specifically, to an upper portion of the support frame 21. The slide portion 220 may be fixed to one end portion of the frame support portion 100 to guide a movement of the frame support portion 100 in the first direction Y. As an example, the slide portion 220 may be arranged to be inserted into the slide guide 210, and thus, the slide portion 220 may move along a route of the slide guide 210. As an example, the weight-measuring portion 150 may be arranged to be fixed to the upper portion of the slide portion 220, as shown in FIG. 7B.

The movement interval adjustment portion 230 is an adjustment member that adjusts a movement interval at which the slide portion 220 may move from the slide guide 210, according to a travel mode. As an example, the movement interval adjustment portion 230 may include a first movement interval adjustment device 231 and a second movement interval adjustment device 232, which are provided in a rod shape and arranged at opposite lateral sides. The first movement interval adjustment device 231 and the second movement interval adjustment device 232 according to an example may be arranged so as to be inserted into a slide rail formed in the slide guide 210. At this time, the first movement interval adjustment device 231 and the second movement interval adjustment device 232 may move along the slide rail (not shown) according to a pre-selected travel mode and restrain a movement interval at which the slide portion 220 may move in a first direction. In addition, when the first movement interval adjustment device 231 and the second movement interval adjustment device 232 are spaced apart by a preset movement interval, positions of the first movement interval adjustment device 231 and the second movement interval adjustment device 232 may be fixed onto the slide guide 210 by using a releasable fixing device (not shown).

The movement interval detection portion 240 may detect and track a movement interval that is generated by the movement of the slide portion 220 along the slide guide 210. As an example, the movement interval detection portion 240 may be a time-of-flight camera (ToF camera), which is a type of depth camera. For example, when the movement interval detection portion 240 is implemented as a ToF camera, the movement interval detection portion 240 may include a light source 241 and a sensor unit 240, wherein the light source 241 radiates certain light, and the sensor unit 240 detects reflected light, which is light that has been irradiated from the light source 241 onto a portion of the slide portion 20 and reflected. In the above-described embodiment, the ToF camera is described as an example of the movement interval detection portion 240, but the present disclosure is not limited thereto. The movement interval detection portion 240 according to an example may be implemented as an arbitrary detection device capable of detecting and tracking a movement interval of the slide portion 220 with respect to the base portion 20.

According to an example, the movement interval detection portion 240 may be arranged to be fixed to the base portion 20 or a device fixed to the base portion 20, for example, the movement interval adjustment portion 230. At this time, the movement interval adjustment portion 230 may be arranged so as to be detachable from the base portion 20. Accordingly, the movement interval detection portion 240 may detect a movement range and left-and-right movement direction of the slide portion 220, more specifically, the frame support portion 100, with respect to the base portion 20. A steering direction of the movement interval detection portion 240 may be detected according to a movement direction of the slide portion 220 detected by the movement interval detection portion 240, and a degree of steering may be detected according to a movement range of the slide portion 220 detected by the movement interval detection portion 240.

As shown in FIG. 1, the steering and movement of the bicycle 10 may be performed by rotating and moving the front wheel 14 by manipulating the handle bar by the rider R. At this time, the rider R must rotate the handle bar of bicycle 10 or maintain a position of the handle bar by using upper body muscles, in order to change or maintain the steering and movement range of the bicycle 10. At this time, the type of the rider R may be various, such as children, the prime-aged, and the elderly, and the capability to change and maintain the steering and movement range of the bicycle 10 may vary according to the type of the rider R.

As described above, because the steering capability of the rider R on the bicycle 10 may vary, it is necessary to adjust the steering and movement range of the bicycle 10 mounted on the bicycle simulator 1 according to the type of the rider R for the safety of the rider R.

Figure 8A:
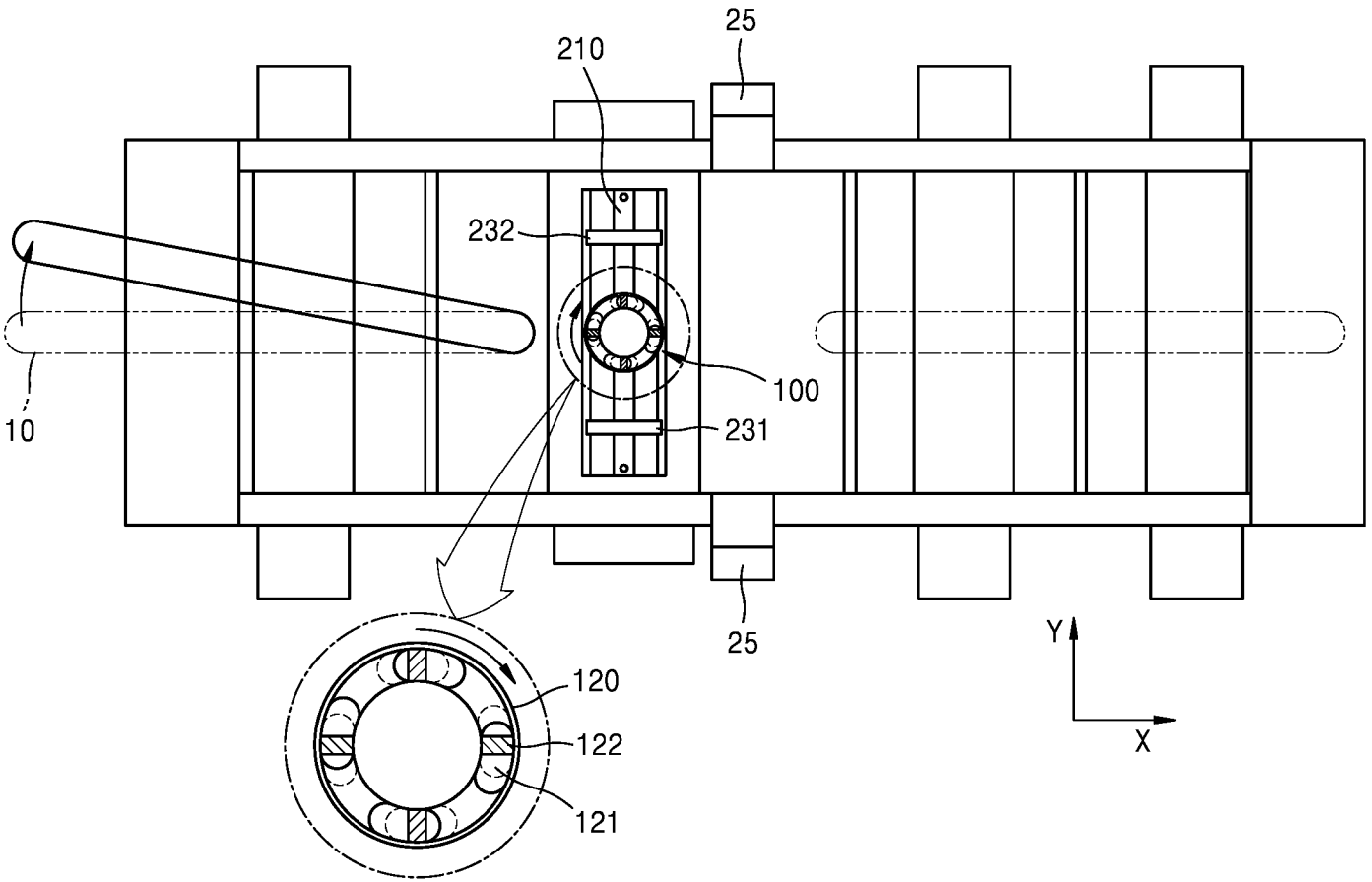
FIG. 8A is a schematic plan view of a bicycle simulator according to steering of a bicycle where a front wheel may first rotate clockwise before a rear wheel.
Figure 8B:
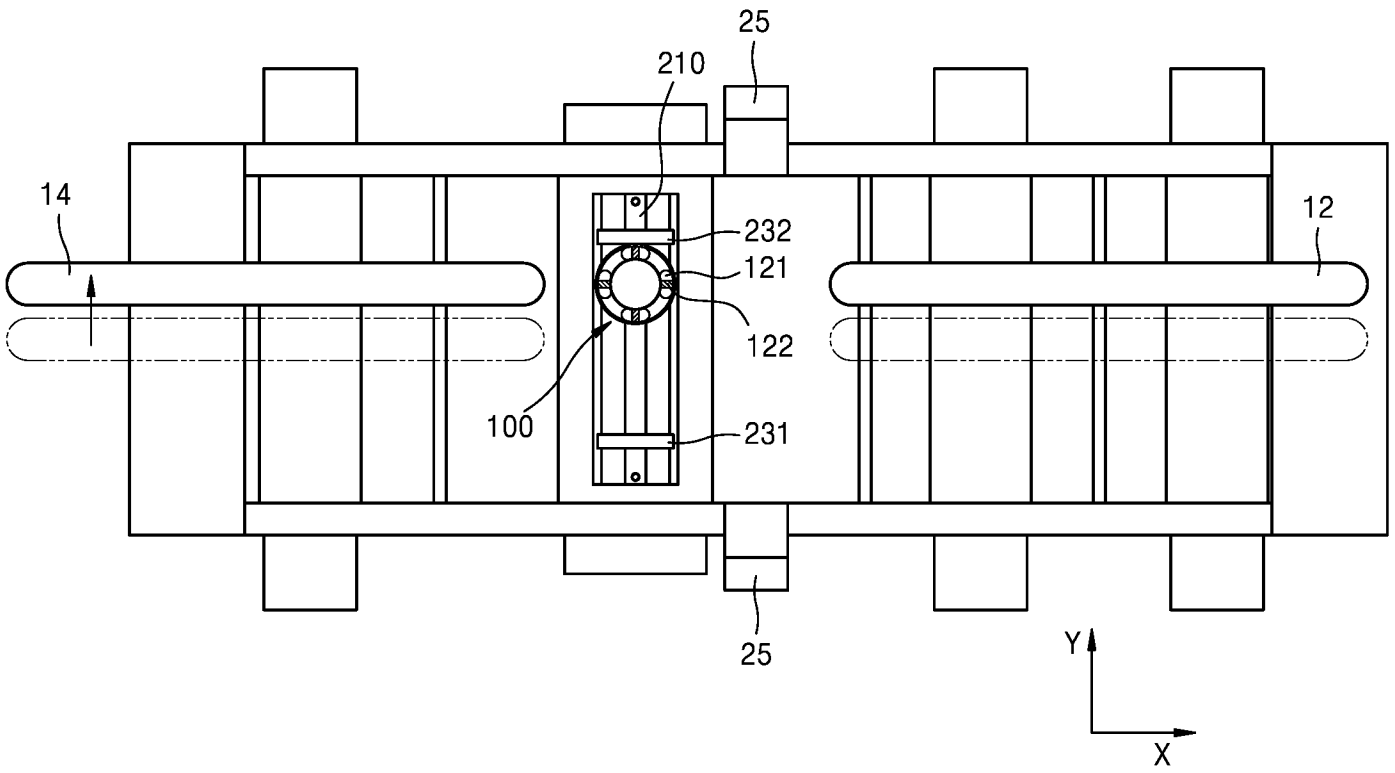
FIG. 8B is a schematic plan view of a bicycle simulator according to steering of a bicycle where the rear wheel may rotate according to the rotation of the front wheel.

FIGS. 8A to 8B are schematic plan views of a bicycle simulator according to steering of a bicycle.

Referring to FIG. 8A, the rider R boarding a bicycle simulator according to an embodiment of the present disclosure steers the bicycle 10 to rotate clockwise in the one axial direction X and a second direction perpendicular to the first direction Y, for example, the Z-axis, the front wheel 14 may first rotate clockwise before the rear wheel 12. At this time, as shown in FIG. 7B, the rotation slide portion 123 provided at one end portion of the second support bar 120 may rotate in a clockwise direction around the Z-axis along the rotation slide guide 180. At this time, the rotation restraint portion 122 may rotate along a plurality of long holes 121 provided in the second support bar 120, and when the second support bar 120 rotates beyond a preset range, for example, beyond 20 degrees, the rotation restraint portion 122 may be supported at one end portion of the plurality of long holes to limit the rotation of the second support bar 120. As the rotation slide portion 123 provided at one end portion of the second support bar 120 rotates about the Z-axis clockwise according to the rotation slide guide 180, the frame support portion 100 supporting the bicycle frame 11 may also rotate about the Z-axis clockwise as shown in FIG. 7A. That is, the frame support portion 100 may rotate clockwise or counterclockwise about the z-axis with respect to the slide portion 220 supported at the therebelow, and at this time, the frame support portion 100 may rotate at an preset angle, for example, at an angle of 0 degrees or more and 20 degrees or less, by the rotation restraint portion 122. As described above, the frame support portion 100 supporting the bicycle frame 11 rotates to correspond to the rotation of the front wheel 14, and thus, the stress due to the relative positional error that may be applied to the frame support portion 100 according to the rotation of the front wheel 14 may be reduced.

Referring to FIG. 8B, the rear wheel 12 may also rotate according to the rotation of the front wheel 14 and the frame support portion 100. As the rear wheel 12 rotates, the front wheel 14 and the rear wheel 12 may be arranged in a straight line, and a position of the bicycle 10 may move along the Y-axis as compared to FIG. 8A.

Figure 9A:
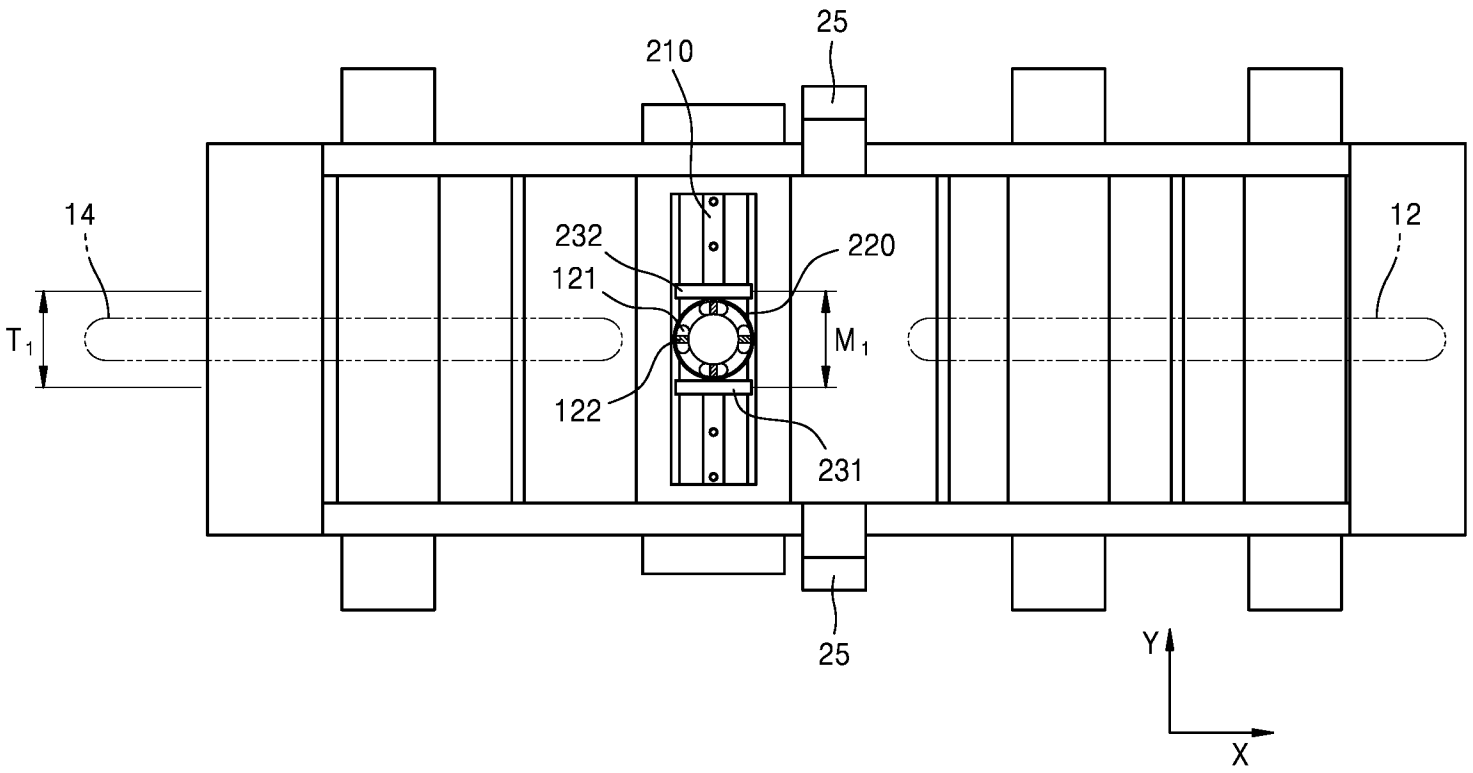
FIG. 9A is a schematic plan view of a bicycle simulator according to a first travel mode.
Figure 9B:
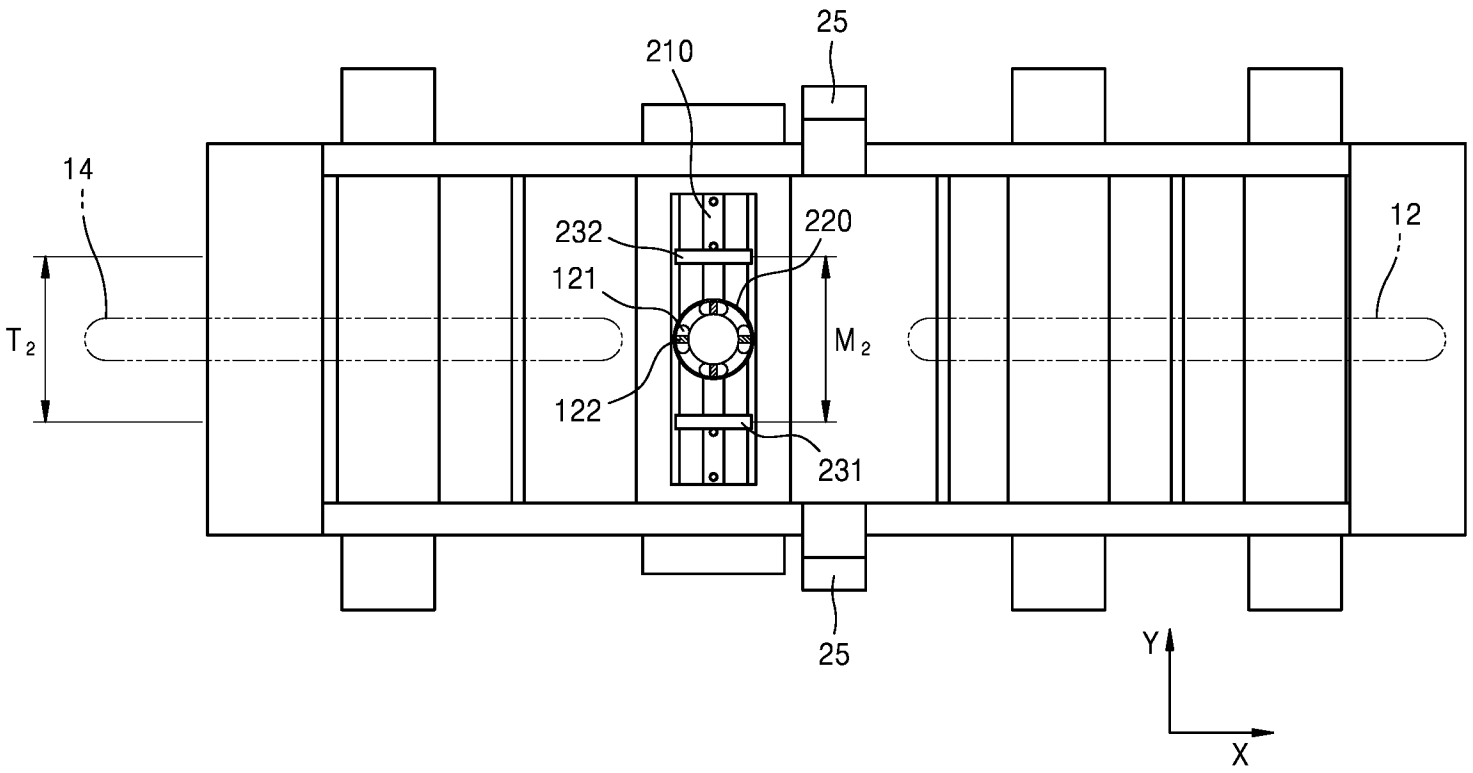
FIG. 9B is a schematic plan view of a bicycle simulator according to a second travel mode.
Figure 9C:
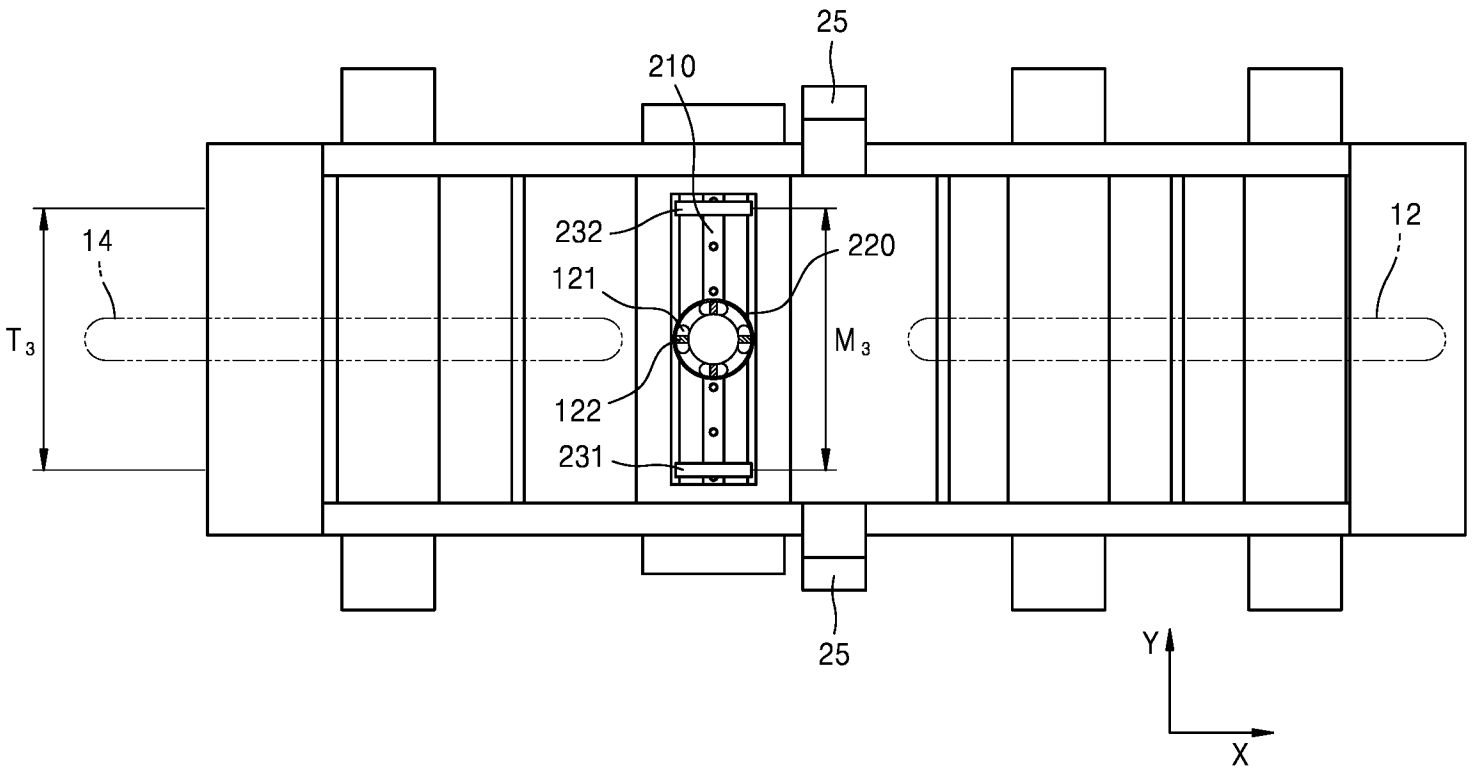
FIG. 9C is a schematic plan view of a bicycle simulator according to a third travel mode.

FIGS. 9A to 9C are schematic plan views of a bicycle simulator according to each travel mode.

Referring to FIG. 9A, in a first travel mode, the slide portion 220 may move from 10 cm or more to 20 cm or less in the first direction Y. At this time, the first movement interval adjustment device 231 and the second movement interval adjustment device 232 may be arranged so as to be spaced apart from each other by the above-described first interval M1, for example, 10 cm or more and 20 cm or less, on the slide guide 210. Therefore, the slide portion 220 may be restrained in its movement range by the first movement interval adjustment device 231 and the second movement interval adjustment device 232, and the bicycle 10 supported by the slide portion 220 may be steered and move only within a first movement range $T_1$ corresponding to the first interval $M_1$ of the first movement interval adjustment device 231 and the second movement interval adjustment device 232.

Referring to FIG. 9B, in a second travel mode, the slide portion 220 may move more than 20 cm and 40 cm or less along the first direction Y. At this time, the first movement interval adjustment device 231 and the second movement interval adjustment device 232 may be arranged so as to be spaced apart from each other by the above-described second interval $M_2$, for example, more than 20 cm and 40 cm or less, on the slide guide 210. Therefore, the slide portion 220 may be restrained in its movement range by the first movement interval adjustment device 231 and the second movement interval adjustment device 232, and the bicycle 10 supported by the slide portion 220 may be steered and move only within a second movement range $T_2$ corresponding to the second interval $M_2$ of the first movement interval adjustment device 231 and the second movement interval adjustment device 232.

Referring to FIG. 9C, in a third travel mode, the slide portion 220 may move more than 40 cm in the first direction Y. At this time, the first movement interval adjustment device 231 and the second movement interval adjustment device 232 may be arranged so as to be spaced apart from each other by the above-described third interval $M_3$, for example, more than 40 cm, on the slide guide 210. Therefore, the slide portion 220 may be restrained in its movement range by the first movement interval adjustment device 231 and the second movement interval adjustment device 232, and the bicycle 10 supported by the slide portion 220 may be steered and move only within a third movement range $T_3$ corresponding to the third interval $M_3$ of the first movement interval adjustment device 231 and the second movement interval adjustment device 232.

As shown in FIGS. 9A to 9C, the first to third intervals $M_1$-$M_3$ of the first movement interval adjustment device 231 and the second movement interval adjustment device 232 may increase. Accordingly, the first to third movement ranges $T_1$-$T_3$ in which the front wheel 14 and the rear wheel 12 of the bicycle 10 may move in the first direction Y on the upper surfaces of the front wheel support portion 40 and the rear wheel support portion 50 may also increase.

As described above, the steering and movement of the bicycle 10 may be performed by a manipulation of the rider R to rotate and move the front wheel 14. At this time, when adjusting a movement range T of the bicycle 10 to adjust a separation interval M of the first movement interval adjustment device 231 and the second movement interval adjustment device 232, the steering and movement range of the bicycle 10 may be restrained within the movement range T described above. At this time, the rider R may select any one of the first to third travel modes by using an input unit 97, and a controller 90 may adjust the movement interval M of the slide portion 220 that may move in the slide guide 210 according to a travel mode input to the input unit 97, to adjust the movement range T of the bicycle 10.

As an example, when the rider R is a beginner unfamiliar with the bicycle 10 or an elderly person with weak muscle strength, the first travel mode may be selected, and accordingly, the bicycle 10 is steered and moves only within the first movement range $T_1$. Thus, a bike ride that is safer may be enjoyed. On the other hand, when the rider R is a person of intermediate level or a youth group familiar with the bicycle 10, the second travel mode may be selected, and accordingly, the bicycle 10 is steered and moves only within a second movement range $T_2$. Thus, a bike ride that is more natural may be enjoyed. In addition, when the rider R is an advanced or professional player who is familiar with bicycle 10, the third travel mode may be selected, and accordingly, the bicycle 10 is steered and move within a third movement range $T_3$. Thus, a bike ride that is more thrilling may be enjoyed.

Figure 10A:
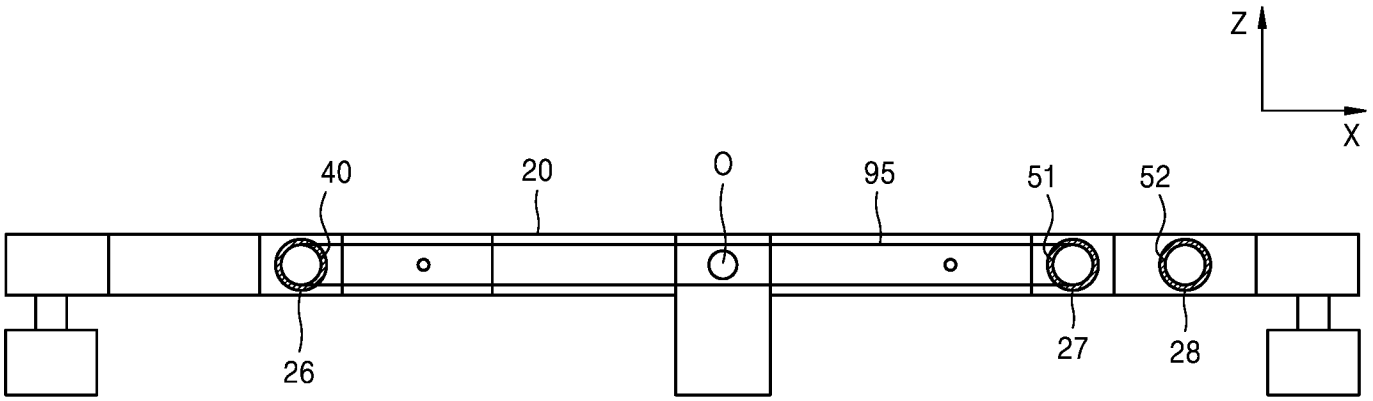
FIG. 10A is a side view of a bicycle simulator according to another embodiment of the present disclosure.
Figure 10B:
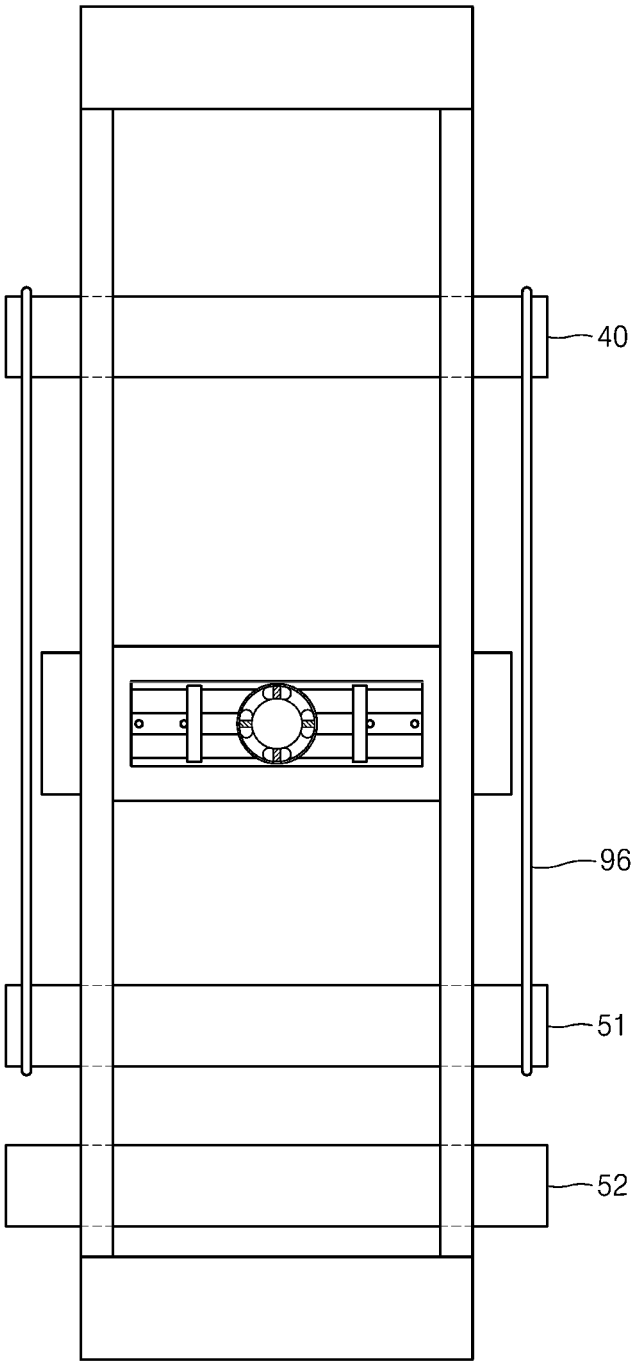
FIG. 10B is a plan view of a bicycle simulator according to another embodiment of the present disclosure.
Figure 10C:
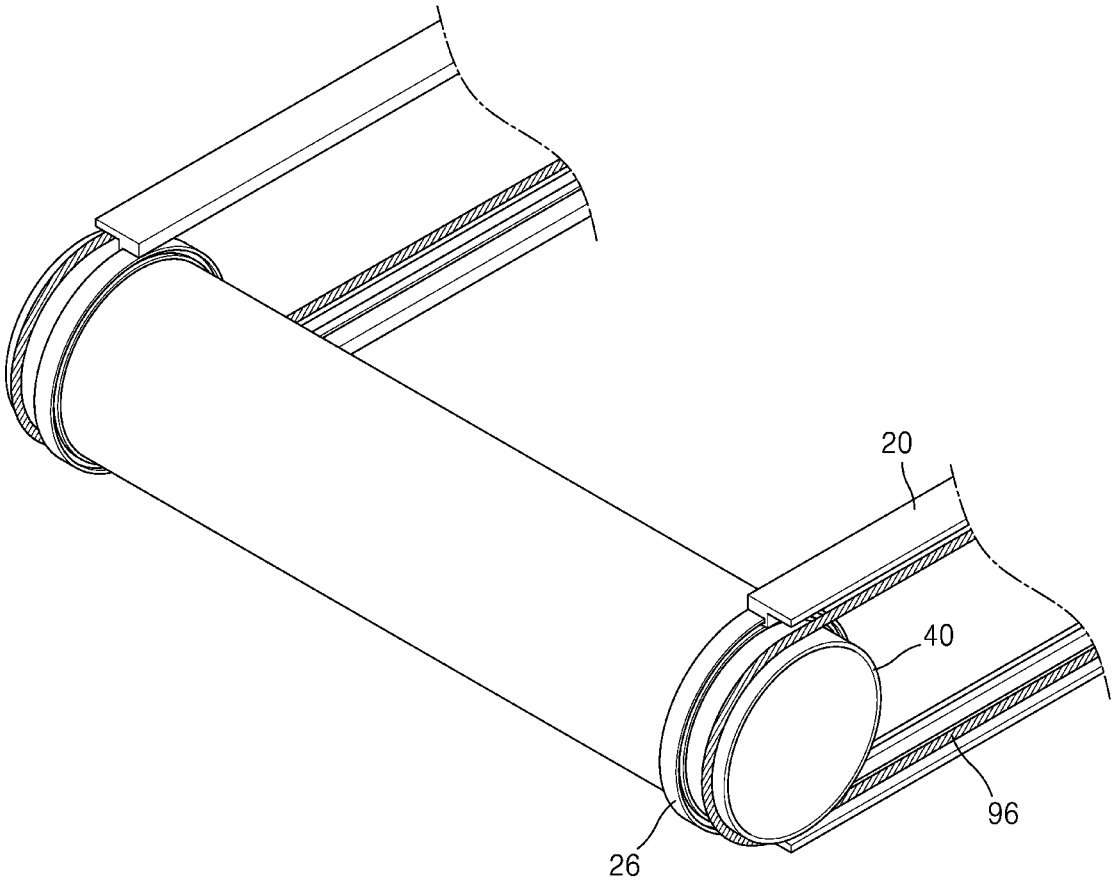
FIG. 10C is a partial perspective view of the bicycle simulator shown in FIG. 10A.

FIG. 10A is a side view of a bicycle simulator, according to another embodiment of the present disclosure. FIG. 10B is a plan view of a bicycle simulator, according to another embodiment of the present disclosure. FIG. 10C is a partial perspective view of the bicycle simulator shown in FIG. 10A.

Referring to FIGS. 10A and 10C, a belt 96 for connecting the front wheel support portion 40 to the first rear roller 51 may be arranged between the front wheel support portion 40 and the first rear roller 51, according to another embodiment of the present disclosure. In this case, the belt 96 is arranged to be wound along the outer circumferential surfaces of the front wheel support portion 40 and the first rear roller 51 so as to transmit rotational force to the front wheel support portion 40 and the first rear roller 51.

As an example, when the rider R rotates the rear wheel 12 of the mounted bicycle 10, the first rear roller 51 may also rotate by the rotational force of the rear wheel 12. At this time, the rotational force of the first rear roller 51 may be transmitted to the front wheel support portion 40 through the belt 96. Thus, the rotational speed of the front wheel support portion 40 is formed equal to that of the first rear roller 51, thereby providing a stable ride experience to the rider R. As an example, the belt 96 may be arranged on an outer side portion of the base portion 20 for convenience of replacement and maintenance. At this time, the front wheel support portion 40, the first rear roller 51, and the second rear roller 52 may each rotate about the base portion 20 without a separate rotation axis, by respectively using bearing portions 26, 27, and 28 each arranged along the outer circumferential surfaces of the front wheel support portion 40, the first rear roller 51, and the second rear roller 52.

In the above, although specific embodiments of the present disclosure have been described and illustrated, it will be obvious to those of skill in the art that the present disclosure is not limited to the described embodiments, and that various modifications and variations may be made without departing from the spirit and scope of the present disclosure. Accordingly, such modifications or variations should not be individually understood from the technical spirit or viewpoint of the present disclosure, and the modified embodiments should be said to belong to the claims of the present disclosure.

What is claimed is:

1. A bicycle simulator comprising:

a frame support portion for supporting a frame of a mounted bicycle, the frame connecting front and rear wheels of the mounted bicycle;

a slide guide fixed to a base portion and extending in a first direction;

a slide portion fixed to the frame support portion and connected to be movable in the first direction in the slide guide; and a movement interval adjustment portion for adjusting a movement interval through which the slide portion is configured to move in the slide guide, according to a travel mode; and wherein, in a first travel mode, the slide portion moves along by an interval of 10 cm to 20 cm, in a second travel mode, the slide portion moves along by an interval of 20 cm to 40 cm, and in a third travel mode, the slide portion moves along by an interval of 40 cm or more.

2. The bicycle simulator of claim 1, further comprising a movement interval detection portion for detecting a movement interval of the slide portion moving along the slide guide.

3. The bicycle simulator of claim 1, further comprising:

an input unit for inputting the first to third travel modes; and a controller for adjusting a movement interval capable of being moved in the slide guide, according to a travel mode input to the input unit.

4. The bicycle simulator of claim 1, further comprising:

a front wheel support portion for supporting the front wheel of the mounted bicycle and rotating together with rotation of the front wheel; and first and second rear wheel support portions that collectively support two points of the rear wheel of the mounted bicycle and rotate together according to rotation of the rear wheel.

5. The bicycle simulator of claim 4, wherein, as the slide portion moves in the first direction, the front wheel of the mounted bicycle moves on an upper surface of the front wheel support portion in the first direction, and the rear wheel of the mounted bicycle moves on upper surfaces of the first and second rear wheel support portions in the first direction.

6. The bicycle simulator of claim 1, further comprising:

a rotation slide guide portion arranged on an upper portion of the slide portion and extending along a circumferential direction around a second direction that is perpendicular to the first direction; and a rotation slide portion which is arranged to be engaged with the rotating slide guide portion and rotates the frame support portion about the second direction with respect to the slide portion.

7. The bicycle simulator of claim 6, further comprising a rotation restraint portion for limiting a rotation angle of the frame support portion with respect to the slide portion.

8. The bicycle simulator of claim 6, wherein a rotation angle of the frame support portion with respect to the slide portion is between 0 and 20 degrees.

* * * * *